United States Patent [19]

Dorsey, Jr.

[11] 4,113,520

[45] Sep. 12, 1978

[54] METHOD OF FORMING AN ALUMINUM OXIDE COATING

[75] Inventor: Geoffrey A. Dorsey, Jr., Danville, Calif.

[73] Assignee: Kaiser Aluminum & Chemical Corporation, Oakland, Calif.

[21] Appl. No.: 714,157

[22] Filed: Aug. 13, 1976

[51] Int. Cl.[2] ..... C23F 7/06

[52] U.S. Cl. ..... 148/6.27; 427/409

[58] Field of Search ..... 148/6.14, 6.27; 427/409

[56] References Cited

U.S. PATENT DOCUMENTS

| | | | |
|---|---|---|---|
| 2,987,426 | 6/1961 | Shaw | 148/6.27 |
| 3,247,026 | 4/1966 | Switzer | 148/6.27 |
| 3,380,860 | 4/1968 | Tipinski | 148/6.27 |
| 3,982,055 | 9/1976 | Howard | 148/6.27 |

FOREIGN PATENT DOCUMENTS

| | | | |
|---|---|---|---|
| 692,344 | 8/1964 | Canada | 148/6.27 |
| 693,876 | 9/1964 | Canada | 148/6.27 |

*Primary Examiner*—Ralph S. Kendall

*Attorney, Agent, or Firm*—Paul E. Calrow; Edward J. Lynch

[57] ABSTRACT

This invention relates to a method of forming an oxide coating on an aluminum surface having a controlled surface resistance and if sufficiently thick have an integral color by treating the aluminum surface with a neutral or slightly basic aqueous solution containing at least 0.001 gm/liter of a difficultly soluble magnesium compound expressed as $MgCO_3$. The temperature of the bath should exceed 65° C and the pH should range from about 7 to 9.

9 Claims, No Drawings

METHOD OF FORMING AN ALUMINUM OXIDE COATING

BACKGROUND OF THE INVENTION

This invention is directed to a nonelectrolytic method of forming an oxide coating on an aluminum surface.

Many processes are presently available for forming various types of coatings on aluminum surfaces, such as anodizing, including integral color anodizing, plating, chemical conversion coating, painting and the like. These coatings, although designed for long life, require extensive surface pretreatments and are quite expensive.

A simple, inexpensive process for coating aluminum is described in U.S. Pat. No. 3,726,721 Wittrock et al assigned to the present assignee. Kubie in U.S. Pat. No. 2,975,491 describes a process for forming a coating designed as an extrusion lubricant wherein the aluminum surface is first treated with an ammonium-laden alkaline solution containing a fatty acid or equivalent salt or ester thereof, and then baked at about 400° F. to form a coating having unknown properties except for lubrication. Marosi in U.S. Pat. No. 3,849,207 describes and claims a process for treating aluminum and other metals wherein the surface is treated with an alkaline sodium formate solution and then coated with a clean resinous film to form a sepia-colored coating.

It is against this background that the present invention was developed.

DESCRIPTION OF THE INVENTION

This invention generally relates to a nonelectrolytic method of forming a useful oxide coating on an aluminum surface. More specifically, the invention is directed to an oxidation process for aluminum which, when controlled to form a thin oxide coating, provides an aluminum surface which is particularly suitable for resistance welding and when controlled to form thicker oxide coatings generate integrally colored oxide coatings.

As used herein, aluminum refers to pure aluminum, commercial aluminum and aluminum alloys. Numbered aluminum alloy identifications herein refer to Aluminum Association alloy designations.

In accordance with the invention, an aluminum workpiece is treated with a hot aqueous solution at neutral or slightly alkaline condition and with difficultly soluble magnesium compounds. Generally suitable are those magnesium compounds which are soluble in distilled or deionized water at 20° C. in amounts less than 30 grams/liter. Suitable magnesium compounds include magnesium carbonate, magnesium hydroxide, magnesium sulfate, magnesium silicate and the like. Magnesium carbonate is preferred. Magnesium concentrations can range generally from about 0.001 to point of saturation (expressed as $MgCO_3$). Preferably, a suspension of the magnesium compound is maintained to assure saturation. The temperature of the aqueous bath should range from about 65° C. to the boiling point of the solution, preferably from about 75°–95° C. The pH of the solution should be about 7–9, preferably about 7.5–8.5. A high pH allows for the use of low bath temperatures, whereas a low pH usually requires high bath temperatures. Treatment times generally are less than about 1 minute for thin colorless oxide coatings but usually are in excess of 5 seconds for coatings of any significant thickness. For integrally colored coatings, treatment times generally range from about 1–60 minutes. With a particular set of bath conditions, treatment times depend to a certain extent upon the alloy composition and the oxide characteristics desired in the final product. The process of the invention should be preceded with an etching step to remove the natural oxide surface and other surface contaminants so that a clean aluminum surface is presented to the treatment solution. To uniformly generate the oxide coating over the aluminum surface, a nonionic or cationic wetting agent in amounts up to 1% by weight can be incorporated into the oxidizing solution.

The process of the invention forms an aluminum oxide coating having a thickness ranging up to about 5000 angstrom units depending upon treatment times and conditions. The oxide coating is essentially all aluminum oxide except for a trace quantity of magnesium hydroxide or other magnesium salt which lies on the surface of the aluminum oxide. Due to the saturation or near saturation of magnesium in the solution, the magnesium alloy constituents in the base metal remain in the aluminum oxide coating, thereby developing the integral color characteristic of the thick oxide coatings of the invention. This feature is contrary to electrolytic anodizing in sulfuric acid and other processes which have a tendency to dissolve the alloying constituents from the aluminum matrix while the oxide coating is being formed.

Control of the bath is simple because generally the magnesium compound does not enter into the reaction and thus only pH and temperature control are really necessary. Occasional additions of the magnesium compounds are necessary to compensate for dragout and surface deposition of magnesium compounds on the aluminum surface.

After the oxide coating of the invention is formed, generally the aluminum article may be treated in a nitric acid solution or its equivalent to remove the heavy layer of smut which forms during oxide formation. Desmutting is particularly desirable if another coating is to be applied onto the oxide layer such as paint or lacquer.

By controlling the thickness of the oxide coating, the initial electrical resistance thereof can be readily controlled within the range of up to about 5000 microhms. The electrical resistance of thin oxide coatings formed in accordance with the invention remains relatively stable at ambient conditions for about 1–3 days and then the natural oxidation of the aluminum substrate begins to accelerate so that after about 2 weeks the electrical resistance of the coating of the invention is essentially that of a natural oxide coating of the same age and thickness depending upon the conditions of exposure. However, by applying a protective coating onto the oxide layer or by developing a further coating, such as is described in co-pending application Ser. No. 610,966 assigned to the present assignee, further natural oxidation of the aluminum surface can be effectively eliminated so that the thickness and the electrical resistance of the oxide coating will be stabilized over a much longer period of time. If the color or the oxide coating is of importance, a clear lacquer or other clear resinous films can be applied to provide suitable protection.

In one embodiment of the invention, the aluminum surface is treated for a period from about 1 to about 60 minutes to develop an oxide coating which has an integral color. The colors can range from a light gold or tan to a dark brown or amber. For a particular set of bath conditions, color generation in the oxide layer is primarily dependent upon the alloy composition and time of treatment. The color generation is believed to be due to the fact that the alloying constituents in the aluminum base are not leached from the oxide surface as it forms, but instead remains occluded within the oxide surface. For example, in high purity aluminum alloys (99.99% + Al), such as 1199 aluminum alloy, no color is generated by the present process even with extended treatment because there are essentially no alloying constituents which can be occluded within the oxide layer to generate the color. For a particular alloy composition and bath conditions, treatment times are lengthened to increase the oxide thickness and to thereby develop darker integrally colored oxide coatings. Higher pH and bath temperatures will hasten coating formation. Because the maximum oxide thickness normally will not exceed ½ micron, the integral color coatings of the invention are usually not suitable for architectural uses where the treated aluminum products will be subject to extensive exposure to the elements. The colored oxide coatings are primarily useful for use in protective environments, such as indoor architectural applications.

In another embodiment, an aluminum surface is treated with the bath for short periods preferably less than about 60 seconds to form a thin oxide coating having an electrical resistance less than about 500 microhms. The oxide resistance developed for a particular set of bath conditions is primarily dependent upon the length of treatment time (i.e., oxide thickness) and can be readily controlled. However, treatment times will vary depending upon bath conditions and can be as low as 5 seconds. The resultant thin oxide coatings are particularly suitable for resistance welding due to their electrical resistance lying within a particularly desirable range for this process. Preferably, the oxide coating is stabilized by treatment with an aqueous alkaline solution containing a long chain of aliphatic carboxylic acid having from 12–22 carbon atoms or an equivalent carboxylate compound as described in co-pending applications Ser. No. 610,966 or Ser. No. 709,026, U.S. Pat. No. 4,004,951 which are hereby incorporated by reference herein in their entirety. The stabilization treatment does not significantly change the surface resistance yet allows storage of the treated aluminum for up to 6 months with essentially no increase in the surface resistance.

A freshly cleaned (i.e., etched) aluminum surface will have an electrical resistance on the order of about 10 microhms. However, due to natural oxidation, the resistance rapidly increases to a level of about 200–1000 microhms or higher depending upon the conditions of exposure. Aging of the natural oxide coating can also significantly increase the oxide resistance.

In commercial spot welding, a consistent surface resistance within the range up to about 500, preferably about 25–300, microhms is desired; however, from a practical standpoint, this was seldom attainable with aluminum products. A consistent resistance is desired so that consistent welding parameters can be used for making sound welds over extended periods. A surface resistance outside the desired range usually causes the deterioration of the electrode after about 20–400 spot welds on aluminum. In many commercial resistance welding facilities, the aluminum surface will be etched and care will be exercised to assure resistance welding within 24 hours after etching to provide consistent surface resistance and to avoid development of excessive surface resistance. However, this procedure has not been very successful in that it is not uncommon when resistance welding aluminum to change electrodes after about 30–40 spot welds. For an excellent discussion of the resistance welding of aluminum and a comparison thereof with the resistance welding of steel products, see Chapters 11 and 12 of WELDING KAISER ALUMINUM (1967).

In many resistance welding facilities, particularly in automotive and truck assembly lines, it is desirable to effect up to 1000, preferably more than 2000, spot resistance welds with the same electrode so that electrode replacement can be minimized during a work period. This requirement presented no problems to steel and other ferrous products; however, heretofore, this requirement could not be met with aluminum products without complex and expensive pretreatments and most importantly it could not be met consistently.

The oxidized aluminum of the invention having a surface resistance less than about 500, preferably about 25–300, microhms, can readily be spot resistance welded. By stabilizing the oxide within the prescribed ranges, aluminum surfaces having consistent resistance can be presented to the spot welder and extended electrode life can be obtained. It has been found that from 2000–4000 or more spot resistance welds can be made per electrode with the oxidized aluminum surfaces of the invention.

The following examples are given to illustrate embodiments of the invention.

EXAMPLE I

A group of aluminum alloys indicated below in the table were treated in an aqueous solution containing about 1 gm/liter $MgCO_3$ (saturated solution) and about 1 gm/liter of a nonionic wetting agent (Tergitol NPX) with the pH controlled to about 8.0 and the temperature controlled to about 80° C. The treatment times and the resultant color of the oxide coating are indicated below.

| Alloy[1] | Treatment Time (Minutes) | Color of Oxide Coating |
|---|---|---|
| 1199[2] | 20 | None |
| 1100 | 10 | Medium Tan |
| 1100 | 20 | Dark Amber |
| 5086 | 20 | Dark Amber |
| 6061 | 20 | Dark Amber |
| 5005 | 10 | Medium Tan |
| 5005 | 20 | Dark Amber |
| 5005 | 10 | Medium Tan |
| 5005 | 20 | Amber |
| 5252 | 20 | Dark Tan |
| 7075 | 20 | Gold |
| 2024 | 20 | Dark Tan |

[1]Aluminum Association Alloy Designations
[2]High Purity (99.99%) Aluminum

EXAMPLE II

A group of aluminum panels was treated for about 30 seconds in a bath which was essentially the same as that described above in Example I to develop a relatively thin aluminum oxide coating of about 100 Å and an electrical resistance of about 75–100 microhms. The panels were removed from the treatment bath and water-rinsed. One portion of the panels was stabilized in a hot aqueous alkaline solution containing stearic acid and a second portion of the panels was stabilized in an identical aqueous alkaline solution except that it contained isostearic acid instead of stearic acid. The bath temperatures were about 85° C., the pH from 9.3 and the carboxylic acid content about 1 gm/liter. The specimens having the coating formed in the alkaline solution of stearic acid allowed over 3000 spot welds before the electrode needed replacement. The specimens which had been treated in the aqueous alkaline solution of isostearic acid allowed approximately 2000 spot welds before the electrode needed replacement. This represents an increase of about 10–100 times in the number of spot welds on aluminum with the same electrode obtained in commercial practice.

The electrical resistance measurements of the aluminum surfaces described herein were measured by means of a surface resistance analyzer Model No. VT-11A sold by the C. B. Smith Company. All discussions herein to surface electrical resistance refer to surface electrical resistance as measured by the aforesaid surface resistance analyzer or its equivalent.

Other uses for the invention are contemplated. For example, the unstabilized oxide coating of the invention can be used as a pretreatment for certain types of bonding adhesives. Furthermore, it is obvious that various modifications and improvements can be made to the invention without departing from the spirit thereof and the scope of the appended claims.

What is claimed is:

1. A method for developing an oxide coating less than 0.5 microns in thickness on an aluminum or aluminum alloy workpiece, wherein said oxide coating consists essentially of oxidized aluminum and alloy constituents from the metal of the workpiece, comprising treating the workpiece with an aqueous solution containing at least 0.001 gram/liter of a difficultly soluble magnesium compound, expressed as $MgCO_3$, with the temperature of the solution ranging from about 60° C. to the boiling point thereof, and with the pH of the solution ranging from 7–8.5.

2. The method of claim 1 wherein the aqueous solution contains a nonionic or cationic wetting agent to insure uniform oxide formation across the workpiece surface.

3. The method of claim 1 wherein the temperature of the bath is controlled between about 70° to 90° C.

4. The method of claim 1 wherein the aluminum workpiece is etched in an aqueous alkaline solution before treatment.

5. The method of claim 1 wherein the aluminum workpiece is desmutted in an aqueous nitric acid solution after treatment.

6. The method of claim 1 wherein a coating of paint or lacquer is applied to the oxide coating developed to prevent the further oxidation of the underlying aluminum workpiece surface.

7. A method of forming an integrally colored oxide coating less than 0.5 microns in thickness on an aluminum or aluminum alloy workpiece, wherein said oxide coating consists essentially of oxidized aluminum and alloy constituents from the metal of the workpiece, comprising treating the workpiece for a period of at least one minute with an aqueous solution containing at least 0.001 gram/liter of a difficultly soluble magnesium compound, expressed as $MgCO_3$, with the temperature of the solution ranging from about 60° C. to the boiling point of the solution and with pH of the solution ranging from about 7–8.5.

8. A method of forming an oxide coating less than 0.5 microns in thickness on an aluminum or aluminum alloy workpiece which is suitable for the spot resistance welding of the aluminum workpiece, wherein said oxide coating consists essentially of oxidized aluminum and alloy constituents from the metal of the workpiece, comprising treating the workpiece with an aqueous solution containing at least 0.001 gram/liter of a difficultly soluble magnesium compound, expressed as $MgCO_3$, with the temperature of the solution ranging from 60° C. to the boiling point of the solution and with the pH ranging from about 7–8.5 so that an oxide coating is formed having an electrical resistance less than about 500 microhms.

9. The method of claim 8 wherein the aluminum surface is treated for about 5–60 seconds to form an oxide coating having an electrical resistance of about 25–300 microhms.

* * * * *